US011970309B2

(12) United States Patent
Parra, Jr.

(10) Patent No.: US 11,970,309 B2
(45) Date of Patent: Apr. 30, 2024

(54) BAG CLOSURE SYSTEM AND ASSOCIATED METHODS

(71) Applicant: Luis Alonso Parra, Jr., Nogales, AZ (US)

(72) Inventor: Luis Alonso Parra, Jr., Nogales, AZ (US)

( * ) Notice: Subject to any disclaimer, the term of this patent is extended or adjusted under 35 U.S.C. 154(b) by 163 days.

(21) Appl. No.: 17/824,795

(22) Filed: May 25, 2022

(65) Prior Publication Data

US 2022/0380092 A1 Dec. 1, 2022

Related U.S. Application Data

(60) Provisional application No. 63/192,750, filed on May 25, 2021.

(51) Int. Cl.
*B65D 33/16* (2006.01)

(52) U.S. Cl.
CPC ..... *B65D 33/1658* (2013.01)

(58) Field of Classification Search
CPC ..... B65D 33/1658
See application file for complete search history.

(56) References Cited

U.S. PATENT DOCUMENTS 892,330 A 6/1908 Tavis
2,151,469 A * 3/1939 Hochtheil ..... B42F 7/08 229/72
3,889,871 A 6/1975 White
4,949,530 A * 8/1990 Pharo ..... B65D 81/03 53/472
5,138,748 A 8/1992 Welles
5,176,452 A 1/1993 Stern
5,674,010 A 10/1997 Dussich
5,947,279 A * 9/1999 Lee ..... B42F 7/08 206/308.1
6,267,506 B1 * 7/2001 Campion ..... A45C 11/22 383/89
6,644,854 B2 * 11/2003 Lien ..... A45F 3/20 383/89
6,837,368 B1 * 1/2005 Chang ..... G11B 33/0444
6,905,064 B1 * 6/2005 Ong ..... B42F 7/08 229/928
9,254,703 B2 * 2/2016 Kuehn ..... B42F 7/04
11,252,809 B2 * 2/2022 Sreshta ..... H02J 7/342
2003/0019780 A1 1/2003 Parodi et al.
2003/0183679 A1 * 10/2003 Ong ..... A45C 3/02 229/928

(Continued)

*Primary Examiner* — David M Upchurch
(74) *Attorney, Agent, or Firm* — ALLEN, DYER ET AL.

(57) ABSTRACT

A bag closure system includes a bag having a top end and a bottom end, and an elastic band having an anchored end and a free end, where the anchored end is fixed proximate the bottom end of the bag. The free end of the elastic band is configured to be stretched around the top end and the bottom end of the bag while the anchored end remains fixed proximate to the bottom end. The elastic band may be made of natural rubber and a permanent adhesive or thermal bond may be used to fix the anchored end proximate the bottom end of the bag. In addition, a visual fold line may be provided diagonally at each of the corners of the bag, and a visual first lateral fold line and a spaced apart visual second lateral fold line provided on the body of the bag.

18 Claims, 4 Drawing Sheets

(56) References Cited

U.S. PATENT DOCUMENTS

| | | | | |
|---|---|---|---|---|
| 2003/0218031 | A1* | 11/2003 | Yang | B65D 33/25 222/527 |
| 2004/0013324 | A1 | 1/2004 | Corry | |
| 2007/0068965 | A1 | 3/2007 | Von Flotow et al. | |
| 2008/0142518 | A1* | 6/2008 | Maistrellis | A45C 13/1069 281/31 |
| 2009/0283197 | A1* | 11/2009 | Gorodisher | A45C 13/1069 156/60 |
| 2011/0019841 | A1 | 1/2011 | Ghazali | |
| 2012/0138666 | A1* | 6/2012 | Ong | B42F 7/08 283/37 |
| 2016/0236826 | A1* | 8/2016 | Hoskins | B65D 33/1658 |
| 2017/0119121 | A1* | 5/2017 | Munoz | A45F 3/005 |
| 2019/0137056 | A1* | 5/2019 | Sreshta | H05B 47/19 |
| 2020/0313610 | A1* | 10/2020 | Thiel | H02S 40/36 |

* cited by examiner

BAG CLOSURE SYSTEM AND ASSOCIATED METHODS

RELATED APPLICATIONS

This application claims priority to U.S. Provisional Application Ser. No. 63/192,750 filed on May 25, 2021 the contents of which are herein incorporated by reference in their entirety.

FIELD

The present invention relates to the field of containers, and, more particularly, to a bag closure system and related methods.

BACKGROUND

Many food products are packaged in flexible container bags. The bags are typically formed of plastic materials and are sealed after filling by the manufacture to provide an air-tight seal. The bags maintain the freshness of the contents until opened. However, once the bags are opened then the contents are subject to losing their freshness and becoming stale unless the container is somehow controlled to avoid contents becoming stale and also control spillage.

Existing attempts to secure the bags closed include the use of clips or twist ties, for example, that hold the sides of the opened end of the bag closed. The consumer has to make an additional purchase for these items. In addition, such devices are separate from the bags and need to be stored separately from the bag when not being used or carried with you to the office to maintain the control of the contents and above all preserving freshness. This makes the existing devices inconvenient. Accordingly, there is a need to develop an improved system to conveniently and effectively seal bags to maintain the freshness of the contents.

SUMMARY

A bag closure system is disclosed. The system includes a bag having a top end and a bottom end, and an elastic band having an anchored end and a free end. The anchored end is fixed proximate the bottom end of the bag. The free end of the elastic band is configured to be stretched around the top end and the bottom end of the bag while the anchored end remains fixed proximate to the bottom end. In addition, a visual fold line may be provided diagonally at each of the corners of the bag, and a visual first lateral fold line and a spaced apart visual second lateral fold line provided on the body of the bag for the user to follow when closing the bag.

A permanent adhesive or thermal bond may be used to fix the anchored end proximate the bottom end of the bag, while a releasable adhesive may be used to removably secure the free end to the bag. The free end of the elastic band may be removably secured towards a middle portion of the bag or proximate the bottom end of the bag. In another aspect, for larger, heavier containers such as dogfood or any other bulk item in a larger container, a mechanical fastener may be used to fix the anchored end proximate the bottom end of the bag.

The elastic band may comprise natural rubber, or braided, knit or woven elastic. The permanent adhesive may comprise an acrylic based adhesive, and the releasable adhesive may comprise pressure sensitive adhesive.

In another aspect a bag closure device is disclosed for a bag having a top end and a bottom end. The device includes an elastic band having an anchored end and a free end, where the anchored end is configured to be fixed proximate the bottom end of the bag. The free end of the elastic band is configured to be stretched around the top end and the bottom end of the bag while the anchored end remains fixed proximate to the bottom end.

In another aspect a method of closing a bag using a bag closing device comprising an elastic band having an anchored end fixed proximate the bottom end of the bag and a free end is disclosed. The method includes stretching the free end of the elastic band around a top end and the bottom end of the bag while the anchored end remains fixed proximate to the bottom end.

BRIEF DESCRIPTION OF THE DRAWINGS

The aspects and the attendant advantages of the embodiments described herein will become more readily apparent by reference to the following detailed description when taken in conjunction with the accompanying drawings wherein.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
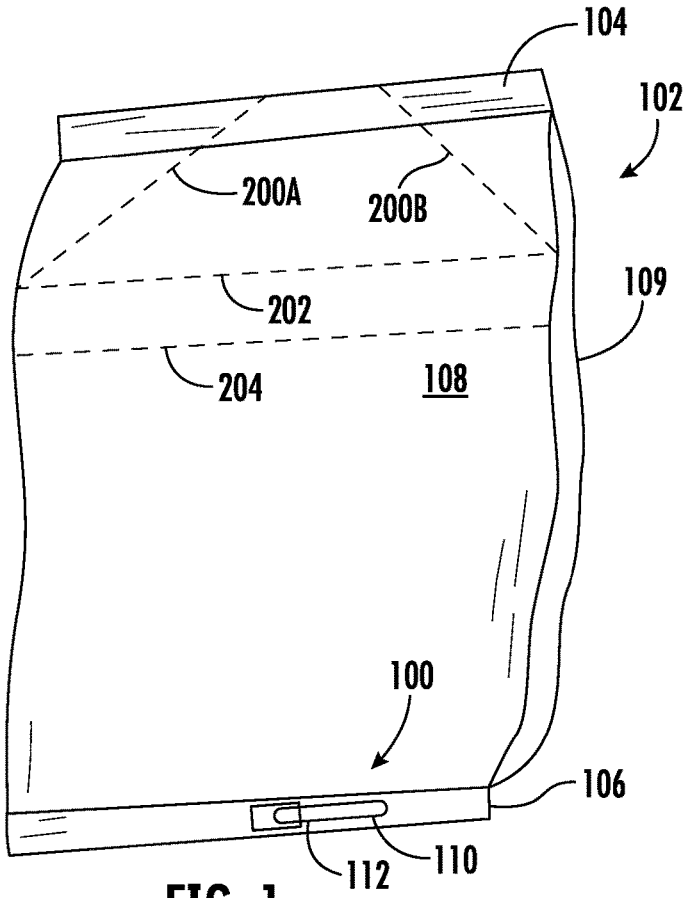
FIG. 1 is a perspective view of a bag closure system in which various aspects of the disclosure may be implemented.
Figure 2A:
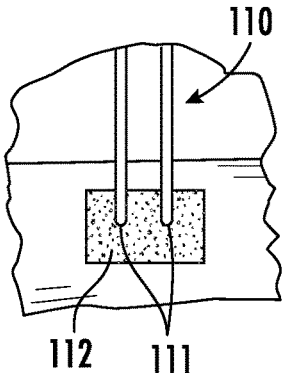
FIG. 2A is a detail view of another aspect of the bag closure system of FIG. 1.
Figure 2:
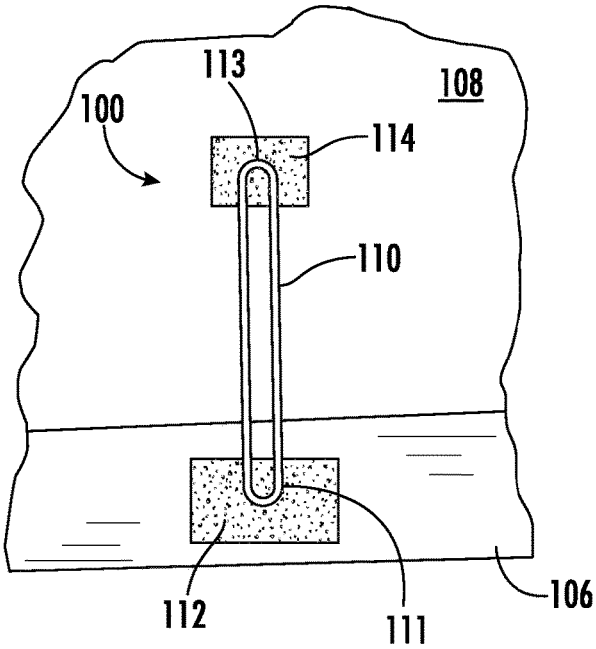
FIG. 2 is a detail view of the bag closure device of the system of FIG. 1.

A bag closure system for resealing a bag after the original seal has been broken is disclosed and generally designated 100. Referring to FIGS. 1 and 2, the system 100 includes a bag 102 having a top end 104 and a bottom end 106. Typically, the top and bottom ends 104, 106 are formed from the front 108 and rear sides 109 of the bag 102 overlapping and being heat sealed together after the food contents are inside. The bag 102 is then airtight and keeps the food fresh.

Figure 2B:
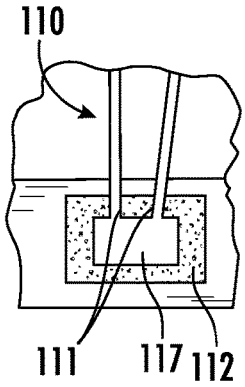
FIG. 2B is a detail view of an anchored end of another aspect of the bag closure system of FIG. 1.

In a particular aspect, an elastic band 110 having an anchored end 111 and a free end 113 is provided as part of the system 100. The elastic band 110 may be a continuous loop as shown in FIG. 2 or have two ends as shown in FIG. 2A. In addition, the elastic band 110 may have a tab 117 formed as part of the anchored end 111 of the elastic band 110 as shown in FIG. 2B. The anchored end 111 of the elastic band 110 is fixed proximate the bottom end 106 of the bag 102. The anchored end 111 may be fixed on the front or rear side of the bag 102.

A permanent adhesive 112 or thermal bond may be used to fix the anchored end 111 proximate the bottom end 106 of the bag, while a releasable adhesive 114 may be used to removably secure the free end 113 to the front side 108 of the bag 102. However, the free end 113 may also not be secured to the bag 102 at all. In addition, the anchored end 111 may be sewed on or tied proximate the bottom end 106 of the bag 102, for example, and be orientated horizontal as shown in FIG. 1, or vertical as shown in FIGS. 2, 2A and 2B.

As those of ordinary skill in the art can appreciate, the anchored end 111 may be positioned in various places on the bag 102. However, the bottom center of the bag 102 is the best location to ensure maximum freshness and avoid spillage.

The elastic band 110 may comprise natural rubber, or braided, knit or woven elastic, a string, adhesive tape, or nylon cable, for example. The permanent adhesive 112 may comprise an acrylic based adhesive, and the releasable adhesive 114 may comprise pressure sensitive adhesive.

In addition, visual fold lines, or "freshness folds" 200A, 200B, 202, 204 may be printed on the bag 102. The fold lines indicate to the user how the bag can be folded to maintain optimum freshness for the contents once the bag 102 is opened. For example, fold lines 200A, 200B are provided diagonally at the corners of the bag, and a first lateral fold line 202 and a spaced apart second lateral fold line 204 are provided on the body of the bag 102.

Figure 3:
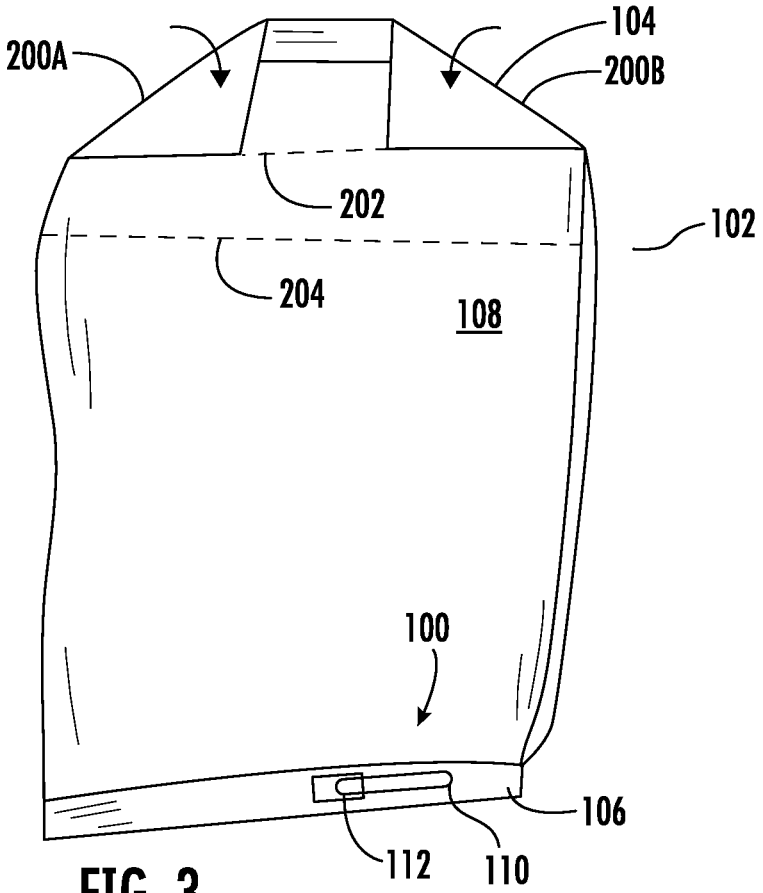
FIG. 3 is a perspective view of an open end of the bag of FIG. 1 being folded diagonally along each of its corners.
Figure 4:
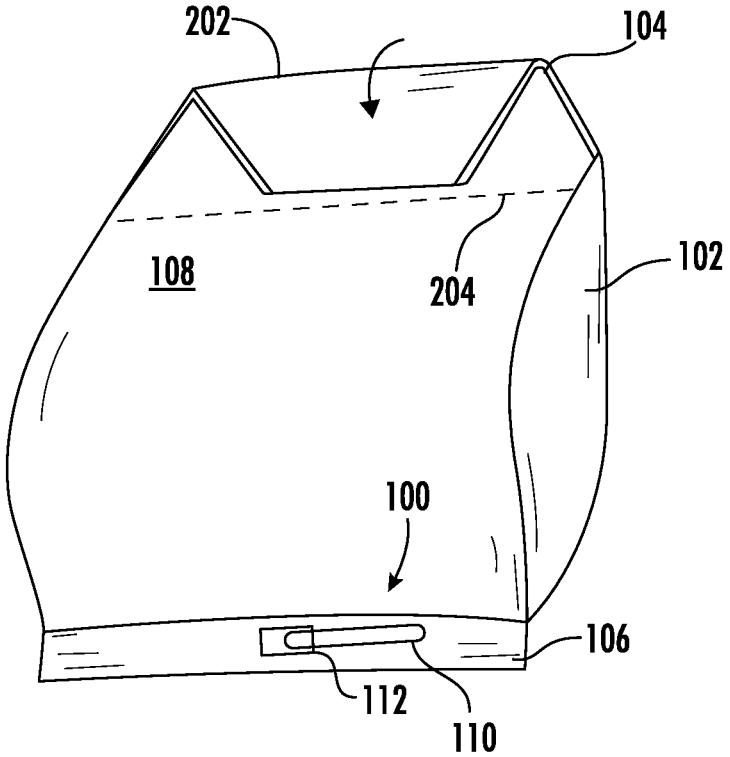
FIG. 4 is a perspective view of the open end of the bag folded back on itself.
Figure 5:
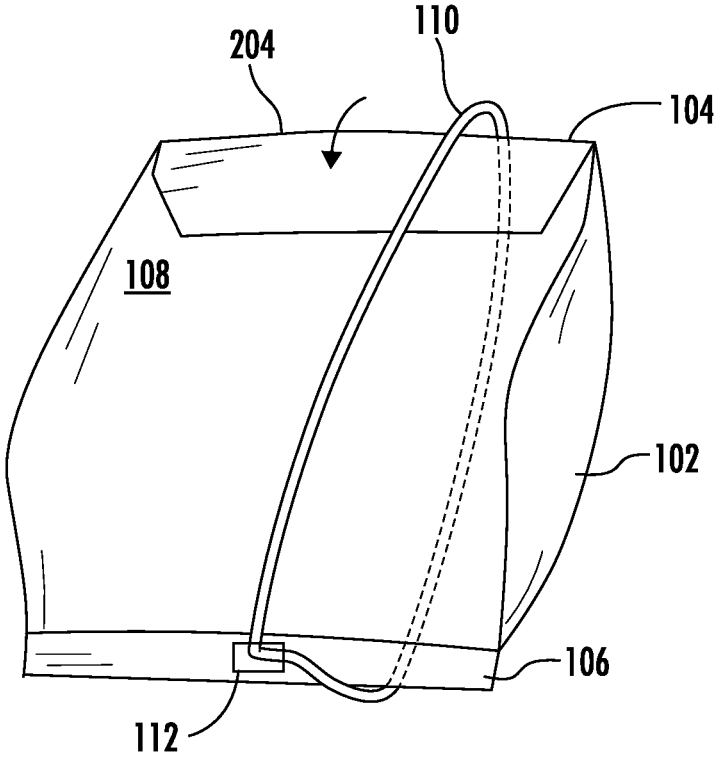
FIG. 5 is a perspective view of an elastic band of the bag closure device being stretched over a top end and a bottom end of the bag.

Once the top end 104 of the bag 102 is opened as shown in FIG. 3, the food contents are subject to the ambient air and begin to lose their freshness. In order to reseal the top end 104 of the bag 102, the top end 104 of the bag 102 is rolled or folded down on itself as shown in FIGS. 3-5. For example, the corners of the bag 102 may be folded along the fold lines 200A, 200B as shown in FIG. 3. Next, the top end of the bag 104 is folded along fold line 202, and subsequently fold line 204 as shown in FIGS. 4 and 5 respectively.

Figure 6:
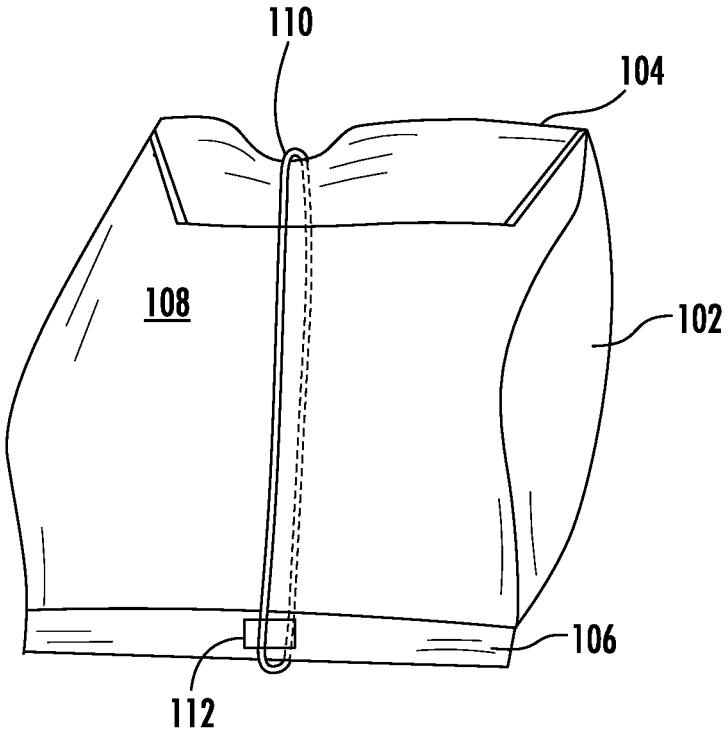
FIG. 6 is a perspective view of the bag closure device secured around the bag and securing the top end of the bag closed.

Next, the free end 113 of the elastic band 110 is pulled from the releasable adhesive 114 (if any) on the front side 108 of the bag 102. The free end 113 is continued to be pulled to elongate the elastic band 110 and increase a length of the elastic band 110 in order to stretch the free end 113 around the top end 104 and the bottom end 106 of the bag 102 while the anchored end 111 remains fixed proximate to the bottom end 106 as shown in FIGS. 5 and 6.

Figure 7:
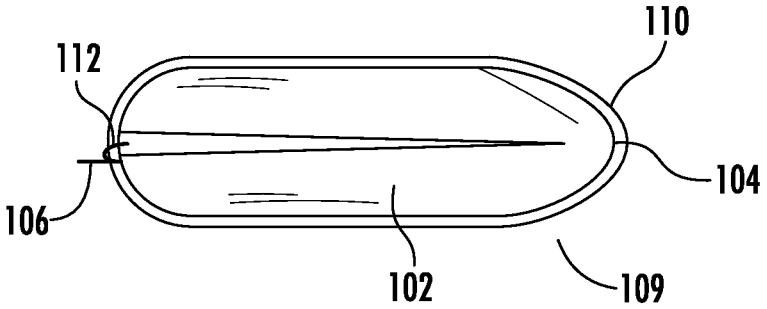
FIG. 7 is an elevational view of the bag closure device secured around the bag of FIG. 6.

Referring now to FIG. 7, the elastic band 110 is shown stretched around the rear side 109, over the top end 104 and the front side 108 of the bag 102. As a result of the physical property of the elastic band 110 to return to its original size and length, a compressive force is exerted on the bag 102 that keeps the top end 104 securely in its rolled down or folded configuration.

Figure 8:
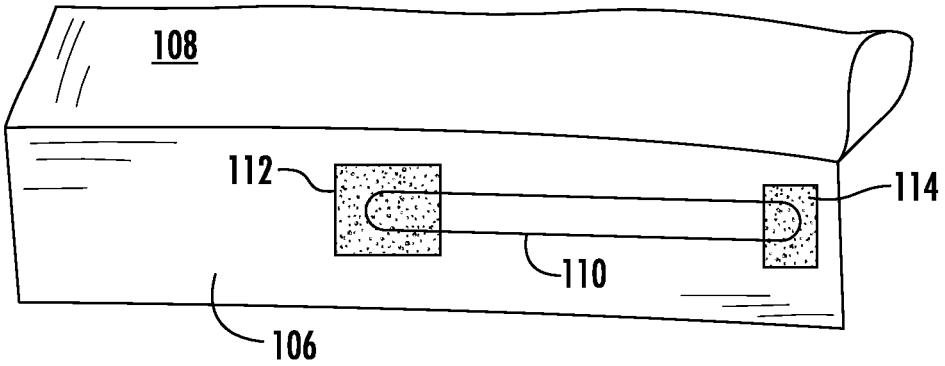
FIG. 8 is a detail view of the free end of the bag closure system secured proximate the bottom end of the bag.

In a particular aspect, the free end 113 of the elastic band 110 may be removably secured towards a middle portion of the bag 102, or proximate the bottom end 106 of the bag 102 as shown in FIG. 8.

Figure 9:
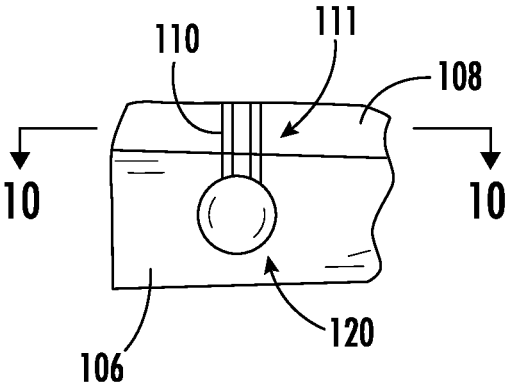
FIG. 9 is a detail view of the anchored end fixed proximate to the bottom end of the bag using a mechanical fastener.
Figure 10:
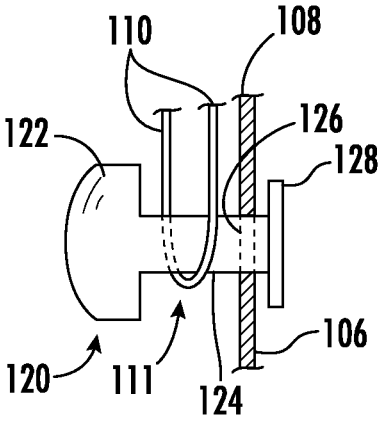
FIG. 10 is a cross sectional view of the mechanical fastener of FIG. 9 fixed proximate to the bottom end of the bag.

In another aspect, a mechanical fastener such as a retaining clip 120, for example, may be used to fix the anchored end 111 proximate the bottom end 106 of the bag 102 as shown in FIGS. 9 and 10. The retaining clip 120 may include a head portion 122 and stem portion 124. The anchored end 111 is looped around the stem portion 124 and sandwiched between the head portion 122 and the front side 108 of the bottom end 106 of the bag 102. The stem 124 passes through an aperture 126 to the rear side 109 of the bag 102 and secured by an end cap 128.

In another aspect a method of closing a bag using the bag closing system 100 described above is disclosed. The method includes folding the corners of the top end of the bag 102 along diagonal visual fold lines, then folding along a first visual lateral fold line and a second spaced apart visual lateral fold line. The method also includes stretching a free end 113 of an elastic band around the folded top end and a bottom end of a bag 102 while an anchored end 111 remains fixed proximate to the bottom end of the bag in order to increase a shelf life of the contents for optimum performance.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

The invention claimed is:

1. A bag closure system, the system comprising:

a bag having a top end and a bottom end;

an elastic band having an anchored end and a free end, the anchored end is fixed proximate the bottom end of the bag; and a permanent adhesive, thermal bond, or stitches to fix the anchored end proximate the bottom end of the bag;

wherein the free end of the elastic band is configured to be stretched around the top end and the bottom end of the bag while the anchored end remains fixed proximate to the bottom end.

2. The bag closure system of claim 1, wherein the elastic band comprises natural rubber.

3. The bag closure system of claim 1, further comprising a releasable adhesive to removably secure the free end to the bag.

4. The bag closure system of claim 1, wherein the bag has two opposing corners at the top end and the bag further comprising a visual fold line provided diagonally at each of the two opposing corners of the bag, and a visual first lateral fold line and a spaced apart visual second lateral fold line provided on the bag.

5. The bag closure system of claim 1, wherein the free end of the elastic band is removably secured proximate the bottom end of the bag.

6. The bag closure system of claim 1, further comprising a retaining clip to fix the anchored end proximate the bottom end of the bag.

7. The bag closure system of claim 1, wherein the elastic band comprises one of braided, knit or woven elastic.

8. The bag closure system of claim 1, wherein the permanent adhesive comprises an acrylic based adhesive.

9. The bag closure system of claim 3, wherein the releasable adhesive comprises pressure sensitive adhesive.

10. A bag closure device for a bag having a top end and a bottom end, the device comprising:

an elastic band having an anchored end and a free end, the anchored end is configured to be fixed proximate the bottom end of the bag; and a permanent adhesive, thermal bond, or stitches to fix the anchored end proximate the bottom end of the bag;

wherein the free end of the elastic band is configured to be stretched around the top end and the bottom end of the bag while the anchored end remains fixed proximate to the bottom end.

11. The bag closure device of claim 10, wherein the elastic band comprises natural rubber.

12. The bag closure device of claim 10, further comprising a releasable adhesive to removably secure the free end to the bag.

13. The bag closure device of claim 10, wherein the free end of the elastic band is removably secured towards a middle portion of the bag.

14. The bag closure device of claim 10, wherein the free end of the elastic band is removably secured proximate the bottom end of the bag.

15. The bag closure device of claim 10, further comprising a mechanical fastener to fix the anchored end proximate the bottom end of the bag.

16. The bag closure device of claim 10, wherein the permanent adhesive comprises an acrylic based adhesive.

17. A method of closing a bag using a bag closing device comprising an elastic band having an anchored end fixed proximate the bottom end of the bag and a free end, and a permanent adhesive, thermal bond, or stitches to fix the anchored end proximate the bottom end of the bag, the method comprising:

stretching the free end of the elastic band around a top end and the bottom end of the bag while the anchored end remains fixed proximate to the bottom end.

18. The method of claim 17, further comprising folding corners of the top end of the bag along diagonal visual fold lines, and folding along a first visual lateral fold line and a second spaced apart visual lateral fold line prior to stretching the free end of the elastic band.

* * * * *